US005416937A

United States Patent [19]

Johenning

[11] Patent Number: 5,416,937

[45] Date of Patent: May 23, 1995

[54] SOFT-SIDED WATERBED

[75] Inventor: John B. Johenning, Beverly Hills, Calif.

[73] Assignee: Strata Flotation, Inc., Torrance, Calif.

[21] Appl. No.: 106,338

[22] Filed: Aug. 13, 1993

[51] Int. Cl.[6] ..... A47C 27/08

[52] U.S. Cl. ..... 5/451; 5/422; 5/917

[58] Field of Search ..... 5/451, 917, 449, 450, 5/452, 455, 422

[56] References Cited

U.S. PATENT DOCUMENTS

| | | | |
|---|---|---|---|
| Re. 32,420 | 5/1987 | Autrey et al. | 5/451 |
| 4,334,331 | 6/1982 | Santo | 5/452 |
| 4,371,998 | 2/1983 | Callaway | 5/451 |

FOREIGN PATENT DOCUMENTS

| | | | |
|---|---|---|---|
| 2097665 | 11/1982 | United Kingdom | 5/917 |

*Primary Examiner*—Alexander Grosz
*Attorney, Agent, or Firm*—Flehr, Hohbach, Test, Albritton & Herbert

[57] ABSTRACT

Waterbed having a plurality of cushioning bolsters extending peripherally of the mattress, with elongated reinforcing elements extending longitudinally of the bolsters. Adjacent ones of the reinforcing elements are connected together at the corners of the bed in a manner permitting the elements to move longitudinally of each other. A liner of water impervious material extends beneath the mattress and along inner sides of the bolsters, and a decorative cover having a layer of water impervious material extending along upper and outer sides of the bolsters is sealed to the liner at the top of the bolsters.

16 Claims, 3 Drawing Sheets

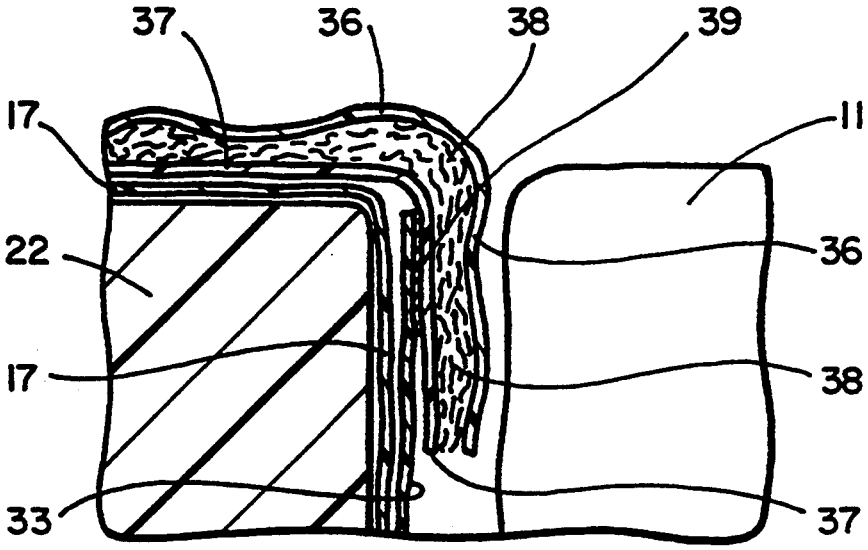
FIG_3
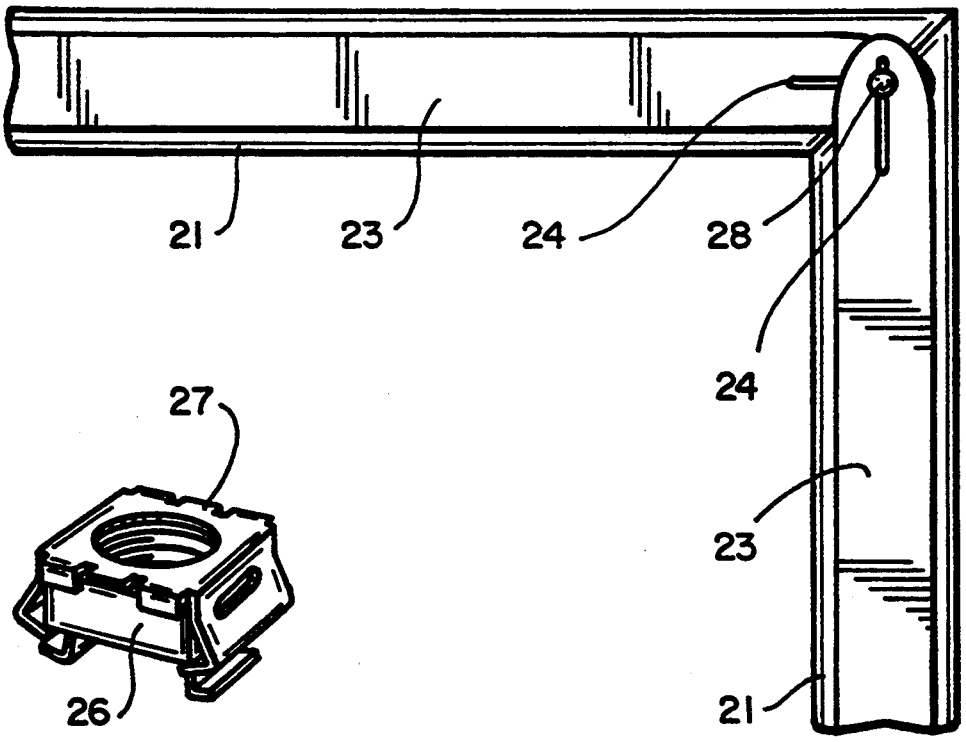
FIG_5
FIG_4

SOFT-SIDED WATERBED

This invention pertains generally to waterbeds and, more particularly, to a waterbed of the type commonly known as a "softside".

Soft-sided waterbeds differ from other types of waterbeds in that they do not a rigid circumscribing frame to provide lateral support for the body of water in the bed. Instead, they have relatively thick foam cushions or bolsters which form a relatively soft peripheral frame for the mattress. One example of a waterbed of that type is found in U.S. Pat. No. 4,014,299.

One problem with soft-sided waterbeds heretofore provided is that the foam cushions tend to bow in an outward direction due to the pressure of the water in the mattress. U.S. Pat. Nos. 3,735,432 and 4,197,602 show the use of rigid elements or stiffeners within the foam cushions to prevent bowing, and U.S. Re. 32,420 shows the use of a rigid circumscribing framework inside the foam cushions.

In a commercial embodiment of the waterbed shown in U.S. Pat. No. 4,197,602, the vertically extending wood frame members shown in the patent were replaced by strips of steel turned horizontally and affixed together at the corners of the bed to form a rigid reinforcing structure which came to be called a "band of steel" in the trade. In addition to the stiffening elements, U.S. Pat. No. 3,735,432 also shows the use of a flexible plastic membrane wrapped about the cushions and sealed to form a hollow watertight recess for the water mattress.

It is in general an object of the invention to provide a new and improved soft-sided waterbed.

Another object of the invention is to provide a soft-sided waterbed of the above character which overcomes the limitations and disadvantages of waterbeds heretofore provided.

These and other objects are achieved in accordance with the invention by providing a waterbed having a water mattress, a plurality of cushioning bolsters extending peripherally of the mattress, elongated reinforcing elements extending longitudinally of the bolsters, means connecting adjacent ones of the reinforcing elements together at a corner of the bed in a manner permitting one of the elements to move longitudinally of the other, a liner of water impervious material extending beneath the mattress and along inner sides of the bolsters, and a decorative cover having a layer of water impervious material extending along upper and outer sides of the. bolsters and sealed to the liner at the top of the bolsters.

FIG. 3 is an enlarged fragmentary cross-sectional view of the embodiment of FIG. 1.

FIG. 4 is a fragmentary horizontal sectional view of the embodiment of FIG. 1.

FIG. 5 is an isometric view of a connector employed in the embodiment of FIG. 1.

Figure 1:
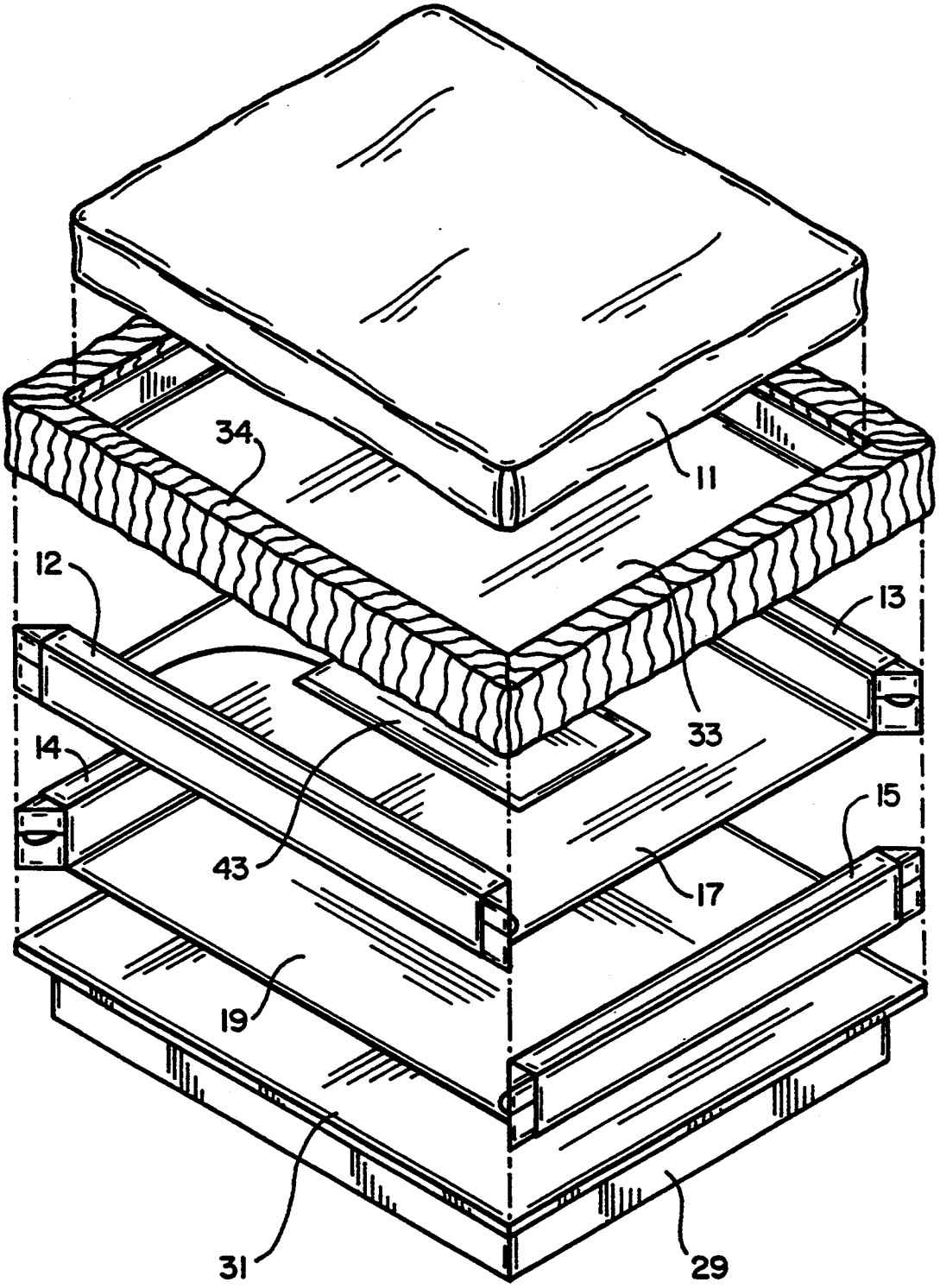
FIG. 1 is an exploded isometric view of one embodiment of a waterbed according to the invention.
Figure 2:
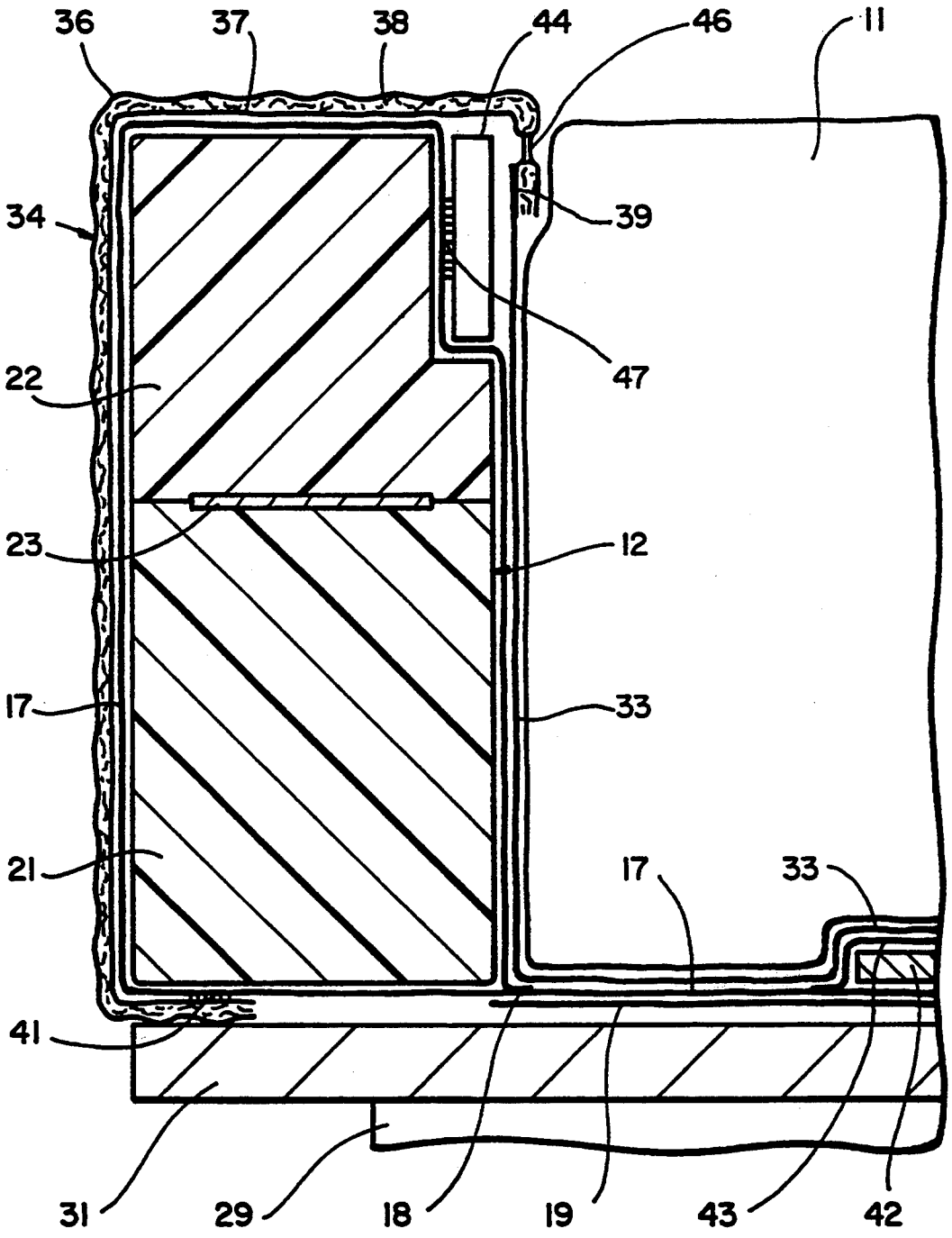
FIG. 2 is a fragmentary vertical sectional view, somewhat schematic, of the embodiment of FIG. 1.

As illustrated in the drawings, the waterbed includes a generally rectangular water mattress 11 which can be of any suitable type. The mattress generally has an envelope or bladder of flexible material which contains a body of water and which may also contain means such as baffles or a fiber mat for reducing wave action in the water and/or enhancing the support provided by the water.

The mattress is supported within a peripheral frame consisting of four bolsters 12–15 arranged in a rectangular pattern, with bolsters 12, 13 extending along the sides of the bed and bolsters 14, 15 extending along the head and foot. The lower portions of the side bolsters are held together by a sheet 17 of flexible material which extends beneath the mattress, wraps around the bolsters and is secured to itself, as indicated at 18. The lower portions of the head and foot bolsters are held together by a sheet 19 of flexible material which extends beneath sheet 17 and wraps around those bolsters. Sheets 17, 19 can be fabricated of any suitable material such as a non-woven olefin fabric marketed under the trademark Duon.

Each of the bolsters consists of two cushions 21, 22, of foam material with an elongated stiffening element 23 extending longitudinally thereof. The lower cushion 21 is fabricated of a denser and therefore somewhat firmer foam material than the upper cushion. In one presently preferred embodiment, the lower cushion is fabricated of a 1.8 pound, 55 ILD polyurethane foam, and the upper cushion is fabricated of a 1.8 pound, 28 ILD foam. In the embodiment illustrated, the bolster has a width on the order of 3–4 inches and a height on the order of 7 inches. In this particular embodiment, cushion 21 has a height on the order of 4 inches and cushion 22 has a height on the order of 3 inches.

Reinforcing elements 23 are fabricated of a material such as spring steel or a suitable plastic, and are in the form of flat bars with rounded ends. The reinforcing elements extend horizontally between the upper and lower cushions. During assembly, an adhesive is applied to the upper surface of the lower cushion, the reinforcing element is placed on that cushion, an adhesive is applied to the upper surface of the reinforcing element, and the upper cushion is placed on top of the lower cushion and the reinforcing element. The reinforcing element is somewhat narrower than the cushions, and the two cushions are cemented together directly at their outer portions as well as being cemented to the reinforcing element. The ends of the cushions are mitered at an angle of 45 degrees, and the rounded end portions of the reinforcing elements project from the mitered ends of the cushions. The projecting end portions are coated with rubber or other suitable material to prevent contact with sharp edges or burrs and to protect against rust.

The reinforcing elements in adjacent ones of the bolsters are connected together at the corners of the bed in a manner which permits one element to move longitudinally of the other. This gives the frame some flexibility which enables the corners of the bed to be lifted more easily when the bed is being made. This flexibility allows the frame to contract as the corners are lifted, rather than remaining stiff and resisting the lifting like rigidly connected elements would.

In this regard, longitudinally extending slots 24 are formed in the end portions of the reinforcing elements, with the slots in adjacent ones of the elements intersecting at the corners of the bed. A nut 26 mounted in a carrier or clip 27 is slidably mounted in the slot in the lower element, and a thumbscrew 28 is slidably mounted in the upper one. The thumbscrew has a threaded shank which extends down through the slot in the upper element and engages the nut, with a knurled head on the upper side of the top element. The thumbscrews are readily accessible by pulling back the confronting ends of the foam cushions, and the frame can be sold and shipped in a knocked down condition for assembly by the user.

The bed can rest on any suitable base or supporting surface, and in the embodiment illustrated, it is shown as having a base consisting of pedestal 29 and a platform 31.

A safety liner 33 comprising a sheet of vinyl or other flexible water impervious material extends beneath the mattress and up the inner sides of the bolsters, and a decorative cover 34 covers the tops and outer sides of the bolsters. As discussed more fully below, the liner and cover are joined together in a novel way to provide an integral structure which does not require any stitching or other holes in the liner.

The cover is a quilted structure comprising an outer layer 36 of fabric, an inner layer 37 of vinyl or other water impervious material, and a filler 38 of suitable material such as polyester fiber. The fabric and vinyl are stitched together in a quilted pattern, and the vinyl is heat sealed or welded to the upper margin the liner along a line 39 about an inch wide spaced about an inch and a half in from the inner edge of the cover. During manufacture, the cover is stitched together first, then it is sealed to the liner. The sealing is done by RF heating, with one sealing bar on top of the fabric and the other in contact with the under or outer side of the liner. The fabric and filler material are transparent to RF energy, whereas the two vinyl sheets are heated by it and fused together.

The portion of the cover between the weld and the inner edge extends down over the upper portion of the inner face of the bolsters and overlies the upper portion of the liner. This gives the bed a finished appearance since the portion of the bolsters which might otherwise be visible around the top of the mattress is covered by the decorative cover. The lower portion of the cover wraps under the outer portion of the bolsters and is secured to the under side of the wrapped bolsters by a Velcro hook and pile fastener 41. Thus, the cover covers all visible portions of the bolsters.

An electric heating element 42 is disposed in a pocket 43 on the upper side of sheet 17 beneath the mattress for heating the water in the mattress. A control 44 for the heater is mounted on the inner side of bolster 12 and is concealed from view by the decorative cover. The control is of known design and has a thermal sensor which monitors the temperature of the water in the mattress, with circuitry responsive to the sensor for controlling energization of the heater to maintain the water at a preset temperature. A zippered opening 46 in the cover provides access to the control, and the control is attached to the wrapped bolster by a Velcro fastener 47. That fastener keeps the control in place during normal use, but will release in the event that someone sits on the control or otherwise applies a force which could damage it.

Although not shown in the drawings, a valve is provided at one corner of the mattress for filling and draining the mattress, and a removable plug is provided in the liner near that corner to permit a hose to pass through the liner and connect to the valve without passing over the frame. If desired, a corresponding opening can also be provided in the platform to accommodate the hose.

The invention has a number of important features and advantages. The reinforcing elements hold the upper portions of the bolsters together and prevent bowing due to pressure from the water, and the sliding connections at the corners provide a flexibility which enables the corners to be lifted without interference from the stiffeners. The manner in which the quilted cover is attached to the liner gives the bed an attractive appearance and provides an integral structure which does not require any holes in the liner. The manner in which the bolsters on opposite sides of the bed are held together by flexible sheets which are superposed beneath the mattress further adds to the stability of the bed and the ease of assembling it.

It is apparent from the foregoing that a new and improved soft-sided waterbed has been provided. While only one presently preferred embodiment has been described in detail, as will be apparent to those familiar with the art, certain changes and modifications can be made without departing from the scope of the invention as defined by the following claims.

I claim:

1. In a waterbed: a water mattress, a plurality of cushioning bolsters extending peripherally of the mattress, elongated reinforcing elements extending longitudinally of the bolsters, means connecting adjacent ones of the reinforcing elements together at a corner of the bed in a manner permitting one of the elements to move longitudinally of the other, a liner of water impervious material extending beneath the mattress and along inner sides of the bolsters, and a decorative cover comprising superposed layers of fabric and water impervious material stitched together in a quilted pattern extending along upper and outer sides of the bolsters, with the layer of water impervious material being sealed to the liner at the tops of the bolsters.

2. The waterbed of claim 1 wherein the reinforcing elements have longitudinally extending slots in the end portions thereof, and the means connecting the elements together includes a nut slidably mounted in a slot in one of the adjacent elements and a bolt threadedly engaged with the nut and slidably mounted in a slot in the other one of the adjacent elements.

3. The waterbed of claim 1 wherein the cover includes a layer of fill material between the layers of fabric and water impervious material.

4. The waterbed of claim 1 wherein each of the bolsters comprises a lower cushion of relatively dense foam material and an upper cushion of a less dense foam material.

5. The waterbed of claim 4 wherein the reinforcing elements are positioned between the upper and lower cushions.

6. The waterbed of claim 1 including an electrically energized heater for heating the water in the mattress and a control for the heater mounted in one of the bolsters with a temperature responsive element for monitoring the temperature of the water and controlling the heater to maintain the water at a predetermined temperature.

7. In a waterbed: a water mattress, a plurality of cushioning bolsters extending peripherally of the mattress, a relatively flat horizontally disposed reinforcing element extending longitudinally within each of the bolsters, longitudinally extending slots formed toward the ends of the reinforcing elements, a first connector part slidably mounted in a slot in one of the elements toward one corner of the bed, and a second connector part engaged with the first connector part and slidably mounted in a slot in a second one of the elements toward the corner of the bed.

8. The waterbed of claim 7 wherein the first connector part comprises a nut and a carrier for the nut slidably mounted in the slot in the first element, and the second connector part comprises a thumbscrew having an enlarged head and a threaded shank which extends through the slot in the second element and engages the nut.

9. The waterbed of claim 7 wherein the ends of the bolsters are mitered and the end portions of the reinforcing elements project from the mitered ends of the bolsters.

10. In a waterbed: a water mattress, a plurality of cushioning bolsters extending peripherally of the mattress, a liner of water impervious material extending beneath the mattress and along inner sides of the bolsters, a layer of fabric and a layer of water impervious material stitched together to form a quilted cover which overlies upper and outer sides of the bolsters, and means sealing the layer of water impervious material and the liner together at the tops of the bolsters.

11. The waterbed of claim 10 wherein a portion of the quilted cover extends along the upper portion of the inner sides of the bolsters in overlapping relationship with the upper portion of the liner and is visible around the upper periphery of the mattress.

12. In a waterbed: a water mattress, a first pair of cushioning bolsters extending along the head and foot ends of the bed, a second pair of cushioning bolsters extending along the sides of the bed, a first sheet of flexible material extending beneath the mattress and wrapped about the bolsters at the ends of the bed, a second sheet of flexible material extending beneath the mattress and wrapped about the bolsters at the sides of the bed, a liner of water impervious material extending beneath the mattress and along inner sides of the bolsters, and a decorative cover extending along upper and outer sides of the bolsters joined to the liner at the tops of the bolsters and affixed to the flexible sheets on the under sides of the bolsters.

13. The waterbed of claim 12 wherein the decorative cover comprises a layer of fabric and a layer of water impervious material sewn together in a quilted pattern, with means sealing the layer of water impervious material to the liner near the tops of the bolsters.

14. The waterbed of claim 12 including a heating element mounted in a pocket on one of the sheets of flexible material beneath the mattress, and a control for the heating element mounted on one of the bolsters about which the one sheet is wrapped.

15. The waterbed of claim 14 wherein the control is mounted on the bolster with a hook and pile fastener.

16. The waterbed of claim 12 including a zippered access opening in the decorative cover adjacent to the control.

* * * * *